US005286402A

United States Patent [19]

Geke et al.

[11] Patent Number: 5,286,402

[45] Date of Patent: Feb. 15, 1994

[54] DEMULSIFYING POWDER-FORM OR LIQUID CLEANING PREPARATIONS AND THEIR USE

[75] Inventors: Juergen Geke; Friedbert Zetzsche, both of Duesseldorf, Fed. Rep. of Germany

[73] Assignee: Henkel Kommanditgesellschaft auf Aktien, Duesseldorf, Fed. Rep. of Germany

[21] Appl. No.: 910,298

[22] Filed: Jan. 12, 1991

[86] PCT. No.: EP 91/00039
§ Jul. 20, 1992
§ Jul. 20, 1992

[87] PCT Pub. No.: WO91/10718
PCT Pub. Date: Jul. 25, 1991

[30] Foreign Application Priority Data

Jan. 20, 1990 [DE] Fed. Rep. of Germany ..... 4001595

[51] Int. Cl.[5] ..... C11D 1/83; C23G 1/00

[52] U.S. Cl. ..... 252/121; 252/550; 252/558; 252/559; 252/174.21; 252/173; 252/531; 252/532; 252/539; 252/DIG. 14; 252/544; 252/525; 252/527; 252/551; 252/109; 252/117; 134/40

[58] Field of Search ..... 252/549, 550, 551, 553, 252/558, 559, 174.21, 173, 108, 109, 117, 121, 135, 133, 531, 539

[56] References Cited

U.S. PATENT DOCUMENTS 4,151,127 4/1979 Perner et al. ..... 252/542
4,784,798 11/1988 Geke et al. ..... 252/544
4,915,864 4/1990 Kita et al. ..... 252/132

FOREIGN PATENT DOCUMENTS 1537265 7/1968 France .

*Primary Examiner*—Paul Lieberman
*Assistant Examiner*—Bradley A. Swope
*Attorney, Agent, or Firm*—Ernest G. Szoke; Wayne C. Jaeschke; Daniel S. Ortiz

[57] ABSTRACT

The invention is a demulsifying cleaning preparation comprising a mixture of nonionic surfactants, anionic surfactants, monocarboxylic acids having 8 to 9 carbon atoms, builders and auxiliaries. The particular proportions of surfactants permits demulsification and rapid separation of oily materials from the detergent mixture.

15 Claims, No Drawings

DEMULSIFYING POWDER-FORM OR LIQUID CLEANING PREPARATIONS AND THEIR USE

FIELD OF INVENTION

This invention relates to demulsifying powder-form or liquid cleaning preparations with which painted and unpainted surfaces of vehicles, engines, floors in workshops or other working surfaces can be cleaned and degreased, the soil removed in the process being demulsified. The invention also relates to the use of these cleaning preparations.

BACKGROUND OF THE INVENTION

U.S. patent application Ser. No. 3,663,445 relates to liquid, storable concentrates consisting of 6 to 45% by weight of a nonionic surfactant,, for example a fatty alcohol ethoxylate, 4 to 33% by weight of an ethanolamine salt of a fatty acid, 2 to 90% by weight of an ethanolamine and 0 to 50% by weight water and to cleaning and degreasing preparations, more particularly for metallic surfaces, which are obtained from the concentrates by dilution with water.

AT-PS 308 936 relates to liquid, storable concentrates consisting of at least 5% by weight of a nonionic surfactant, for example a fatty alcohol ethoxylate, at least 3% by weight of a saturated or unsaturated fatty acid containing 8 to 22 carbon atoms in the molecule, at least 4.5% by weight of one or more alkanolamines and typical additives, such as complexing agents, and water and to cleaning and degreasing preparations obtainable from the concentrates by dilution with water.

GB-PS 1,321,513 relates to a process for cleaning metal surfaces using two cleaning baths applied one after the other, namely a precleaning bath and a degreasing bath. The precleaning bath consists of at least 5% by weight of a nonionic surfactant containing 3 to 5 mol ethylene oxide, at least 3% by weight of a fatty acid and/or an alkyl polyethylene oxide carboxylic acid, at least 1. 5% by weight of an alkanolamine and/or oxazine and, for the rest, of water. The degreasing bath consists of an inorganic or organic alkaline substance, for example potassium hydroxide, potassium carbonate, potassium orthophosphate, potassium pyrophosphate, potassium borate, alkanolamine, preferably mono-, di- or triethanolamine, morpholine, and a complexing agent, a low-foaming surfactant, for example a condensation product of fatty acids with 3 to 5 mol ethylene oxide, and other additives and, for the rest, of water.

AT-PS 299 421 relates to a water-based liquid detergent for dishwashing machines containing 2 to 6% by weight of anonionic surfactant, 15 to 25% by weight of an organic sequestrant, 7 to 15% by weight of a hydrotropic substance, 3 to 15% by weight of an ethanolamine and 0.1 to 0.6% of a corrosion inhibitor.

U.S. patent application Ser. No. DE. 25 05 252 relates to a process for the industrial cleaning and degreasing of articles, more particularly of metals, by treatment of the articles with a solventless aqueous solution containing an organic sequestrant and a hydrotropic substance, characterized in that the aqueous solution used contains 0.1 to 204 by weight of an organic hydrotropic electrolyte in the form of benzenesulfonates, lower alkylbenzenesulfonates, di-(lower alkyl)-benzenesulfonates or mixtures thereof and 0.1 to 254 by weight of an organic sequestrant in the form of aminopolycarboxylic acids or aminopolyphosphonic acids or salts or mixtures thereof, the ratio by weight of the electrolyte to the sequestrant being 2:1 to 1:3 and the pH value of the solution being in the range from 9 to 13.

U.S. patent application Ser. No. 4,321,166 relates to liquid cleaning preparations containing 20 to 704 by weight of a surfactant, for example a fatty alcohol ethoxylate, 0.85 to 2% by weight of a corrosion inhibitor system consisting essentially of a mixture of an oligomeric olefinic fatty acid and an aromatic triazole and 1 to 75% by weight water.

U.S. patent application Ser. No. DE. 35 30 623 relates to demulsifying cleaning preparations with a surface moisturizing effect which contain builders/complexing agents in a quantity of 0.5 to 10% by weight, one or more alkanolamine(s) in a quantity of 20 to 604 by weight, one or more nonionic surfactant(s) in a quantity of 1 to 15% by weight and, for the rest, water. These cleaning preparations and corresponding cleaning compositions are suitable for the cleaning and degreasing of painted and unpainted vehicle surfaces, engines, floors and walls of workshops, etc., even at room temperature, with demulsification of the oily or greasy soil removed.

However, the demulsifying effect of these known cleaning preparations does not satisfy present-day requirements. In other words, their demulsification of the oil-containing soil removed and the resulting, subsequent separation of oil are not sufficient to reduce the residual oil contents in the wastewater to the low levels required today.

By contrast, the problem addressed by the present invention was to provide demulsifying cleaning preparations for the cleaning of hard surfaces soiled with oil which would have a better demulsifying effect and also a better cleaning effect than known cleaning preparations. In addition, the demulsifying effect of the cleaning preparations would result in improved oil removal and hence in lower residual oil contents in the wastewater.

BRIEF DESCRIPTION OF THE INVENTION

It has surprisingly been found that the stated requirements are satisfied by a special combination of alkyl ethoxylates, monocarboxylic acids and anionic surfactants which may optionally contain builders.

Accordingly, the present invention relates to demulsifying, powder-form or liquid cleaning preparations based on nonionic surfactants, carboxylic acids, anionic surfactants and, optionally, builders, characterized in that they contain a combination of the following constituents:

a) at least one alkyl ethoxylate corresponding to general formula (I):

$$R^1—O—(CH_2CH_2O)_n—H \quad (I)$$

in which $R^1$ is a linear or branched alkyl radical containing 6to 9 carbon atoms and n is a number of 3 to 10, b) at least one monocarboxylic acid corresponding to general formula (II):

$$R^2—COOH \quad (II)$$

in which $R^2$ is a linear or branched alkyl radical containing 5 to 11 carbon atoms, or water-soluble salts thereof, c) at least one anionic surfactant selected from the group consisting of c1) alkyl sulfates corresponding to general formula (III):

$$R^3—O—SO_3Me \quad (III)$$

c2) alkyl polyglycol ether sulfates corresponding to general formula (IV):

$$R^4—O—(CH_2CH_2O)_m—SO_3Me \quad (IV)$$

c3) alkylaryl sulfonates corresponding to general formula (V):

$$R^5—SO_3—Me \quad (V)$$

in which $R^3$ and $R^4$ independently of one another represent linear or branched alkyl radicals containing 10 to 18 carbon atoms, m is a number of 1 to 6, $R^5$ represents alkylbenzene groups containing 7 to 9 carbon atoms and Me is an alkali metal atom, the total content of components a), b) and c) in the cleaning preparation being from 1.5 to 15% by weight, the ratio by weight of a) to b) being from 3:1 to 1:6 and the ratio by weight of (a+b) to c being from 3:1 to 1:3, d) 0 to 98.5% by weight of at least one organic or inorganic builder selected from the group consisting of oligo- and polycarboxylic acids or water-soluble salts thereof and the alkali metal phosphates, silicates, borates, carbonates and hydroxides, e) up to 100% by weight powder-form or liquid auxiliaries or diluents.

The demulsifying cleaning preparations according to the invention show excellent cleaning potential. By virtue of the good demulsifying effect of the cleaning preparations, the oil-containing contaminations removed automatically separate on dilution of the aqueous in-use solution. Grease and oils washed off the substrate surfaces in this way can thus be removed easily and without difficulty from aqueous media, for example via simple oil separators. In this way, the wastewaters are always suitable for receiving waters.

DETAILED DESCRIPTION OF THE INVENTION

In one preferred embodiment of the present invention, the demulsifying cleaning preparations contain 2.5 to 12.5% by weight of a combination of components a), b) and c), 5 to 97.5% by weight of a builder and up to 100 4 by weight auxiliaries and/or diluents.

In general formula (I) above for component (a) (alkyl ethoxylates), $R^1$ is a linear or branched alkyl radical containing 6 to 9 carbon atoms. Accordingly, the substituent $R^1$ may be selected from the following radicals: n-hexyl, n-heptyl, n-octyl and n-nonyl and the branched-chain isomers of these alkyl radicals. The number of ethoxy groups in the molecule —n— is in the range from 3 to 10. According to the invention, corresponding adducts of ethylene oxide with fatty alcohols are particularly suitable as component (a). Fatty alcohol ethoxylates such as these may be used both individually and in combination.

In one preferred embodiment of the invention, component (a) is an adduct of 4 to 6 mol ethylene oxide with n-octanol, more particularly the adduct of 4 mol ethylene oxide with n-octanol.

In general formula (II) above for component (b), $R^2$ is a linear or branched alkyl radical containing 5 to 11 carbon atoms. Accordingly, monocarboxylic acids in the context of this general formula may be any of the following linear fatty acids: hexanoic acid (caproic acid), heptanoic acid (oenanthic acid), octanoic acid (caprylic acid), nonanoic acid (pelargonic acid), decanoic acid (capric acid), undecanoic acid and dodecanoic acid (lauric acid) . In addition, component (b) may be selected from the corresponding branched-chain monocarboxylic acids. These monocarboxylic acids of component (b) may also be used both individually and in combination with one another. Suitable water-soluble salts of such monocarboxylic acids are, in particular, the alkali metal salts, preferably the sodium salts.

In another preferred embodiment of the invention, branched-chain monocarboxylic acids containing a total of 8 to 9 carbon atoms are used as component (b), 2-ethyl hexanoic acid being particularly preferred.

At least one anionic surfactant selected from the group consisting of the alkyl sulfates of general formula (III), the alkyl polyglycol ether sulfates of general formula (IV) and the alkylaryl sulfonates of general formula (V) is used as component (c) in the demulsifying cleaning preparations according to the invention. In general formulae (III) and (IV) above, the substituents $R^3$ and $R^4$ independently of one another represent linear or branched alkyl radicals containing 10 to 18 carbon atoms. Accordingly, the substituents $R^3$ and $R^1$ may be selected from the following radicals: n-decyl, n-undecyl, n-dodecyl, n-tridecyl, n-tetradecyl, n-pentadecyl, n-hexadecyl, n-heptadecyl and n-octadecyl and also the branched-chain isomers of the alkyl radicals mentioned. The number of ethylene oxide units—m—in the alkyl polyglycol ether sulfates of general formula (IV) is in the range from 1 to 6. The substituent $R^5$ in the alkylaryl sulfonates corresponding to general formula (V) is selected from alkylbenzene groups containing 7 to 9 carbon atoms from the group consisting of toluene, xylene, mesitylene and cumene. In general formulae (III), (IV) and (V) above, Me is an alkali metal atom, preferably sodium.

The total content of components (a), (b) and (c) in the cleaning preparations according to the invention is from 1.5 to 15% by weight. According to the invention, it is also important that the ratio by weight of component (a) to component (b) is in the range from 3.11 to 1:6 and that the ratio by weight of the sum of components (a) and (b) to component (c) is in the range from 3:1 to 1:3.

In another preferred embodiment of the invention, a $C_{12-14}$ fatty alcohol sulfate sodium salt and/or a $C_{12-14}$ fatty alcohol ether sulfate sodium salt containing 3 to 5 mol ethylene oxide and/or the sodium salt of cumenesulfonate is used as component (c).

To support their activity, the demulsifying cleaning preparations according to the invention may optionally contain at least one organic or inorganc builder. Suitable builders are, for example, oligo- or polycarboxylic acids and water-soluble salts thereof, for example ethylenediamine tetraacetic acid, nitrilotriacetic acid, diethylenetriamine pentacetic acid or n-(2-hydroxyethyl)-ethylenediamine triacetic acid, preferably in the form of their alkali metal salts, more particularly their sodium salts. Other suitable builders in the context of the invention are alkali metal phosphates, polyphosphates, silicates, borates, carbonates and/or hydroxides, again preferably in the form of the corresponding sodium salts.

According to the invention, the sodium salts of ethylenediamine tetraacetic acid and/or nitrilotriacetic acid are preferably used as builders.

The demulsifying cleaning preparations according to the invention also contain powder-form or liquid auxiliaries and/or diluents which make up the percentage contents of components (a), (b), (c) and, optionally, (d) present in the cleaning preparations to 100% by weight. The auxiliaries and/or diluents are used in particular for making up the cleaning preparations according to the invention either as powders or as liquids. Where liquid formulations are required, water in particular is used as diluent. Suitable powder-form diluents which lead to powder-form formulations are alkali metal sulfates or carbonates, more particularly in the form of their sodium salts, or urea. The cleaning preparations according to the invention may also contain small quantities of oleic acid or its sodium salt and of diethanolamine and/or triethanolamine as auxiliaries.

The cleaning preparations according to the invention are prepared by mixing the components mentioned above in the respective quantities by methods known per se. The cleaning preparations are generally stored and transported in the form of an aqueous or powder-form concentrate which contains the combination of components mentioned and on which the quantities indicated (in % by weight) are based. For cleaning and degreasing painted and unpainted surfaces of vehicles, engines, floors and walls, etc., the demulsifying cleaning preparations according to the invention are used in any dilution with water, depending on the method of application and the degree of soiling of the surfaces to be cleaned. According to the invention, it is preferred in this regard to use the cleaning preparations in water-diluted in-use solutions for the cleaning and degreasing of hard surfaces, the concentration of components (a), (b) and (c) together in these in-use solutions being from 0.01 to 3% by weight and, more particularly, from 0.025 to 1% by weight.

The pH value of the aqueous in-use solutions is in the range from 7.5 to 13 and, more particularly, in the range from 9.5 to 11.5.

The invention is illustrated by the following Examples (in which the abbreviation EO stands for ethylene oxide):

EXAMPLE 1

A liquid cleaning preparation is prepared by mixing 1.8% by weight of a condensation product of n-octanol with 4 mol EO,
1.8% by weight 2-ethylhexanoic acid,
0.3% by weight $C_{12-14}$ fatty alcohol ether sulfate with 3 mol EO sodium salt,
2.6% by weight sodium cumenesulfonate,
28.0% by weight ethylenediamine tetraacetic acid sodium salt,
0.8% by weight triethanolamine,
0.4% by weight oleic acid and
64.3% by weight water.

EXAMPLE 2

A powder-form cleaning preparation is prepared by mixing 3. 0% by weight of a condensation product of n-octanol with 4 mol EO,
2.0% by weight 2-ethylhexanoic acid,
1.0% by weight $C_{12-14}$ fatty alcohol sulfate sodium salt,
3.0% by weight sodium cumenesulfonate,
36.8% by weight nitrilotriacetic acid sodium salt,
1.0% by weight oleic acid,
38.6% by weight sodium carbonate and
14.6% by weight urea.

COMPARISON EXAMPLE

Commerical Product According to DE-OS 35 30 623

A comparison cleaning preparation was prepared by mixing 5.0% by weight of a condensation product of n-octanol with 4 mol EO,
1.6% by weight sodium cumenesulfonate,
2.4% by weight ethylenediamine tetraacetic acid sodium salt,
42.0% by weight of a mixture of diethanolamine and triethanolamine in a ratio of 2:1 and
49.0% by weight water.

APPLICATION EXAMPLE 1

Oil Values in Wastewater

Oil-containing wastewaters were prepared with the cleaning preparations of Examples 1 to 2 and the Comparison Example in accordance with the "Technische Liefervorschrift der Deutschen Bundesbahn (Technical Supplier's Specification of Federal German Railways)" TL 918 81, page 6. The concentration of the cleaning preparations in the aqueous solutions was 1.2% by weight; the oil load—produced with squalene as mineral oil—was 1,000 ppm. After separation of the oil phase from the aqueous phase, the residual oil values in the aqueous phase were determined in accordance with the above-cited supplier's specification. The residual oil values in the wastewater were as follows:

Example 1: 12 ppm
Example 2: 31 ppm
Comparison Example: 78 ppm

In Examples 1 and 2, the separation time or standing time before phase separation was only 5 minutes as against the 30 minutes required in the case of the comparison cleaning preparation.

APPLICATION EXAMPLE 2

Cleaning Effect

Testing of the cleaning effect and relative cleaning effect $CE_{rel}$ (again by comparison with the cleaning preparation according to DE-OS 35 30 623).

A painted, heavily soiled inside of a car bonnet was arranged in an upright position. 2.5% by weight cleaning solutions were prepared as test solutions from the cleaning preparations of Examples 1, 2 and the Comparison Example by dilution with water (16·Gh=German hardness).

Viscose sponges measuring 90×50×40 Mm were immersed in these test solutions, saturated and individually placed on edge for 3 minutes to allow the excess solution to drain off.

The sponges thus prepared—arranged one adjacent the other at an angle of 45° with the edge—were wiped once per second over the soiled surface under light pressure until the surface was clean. Saturation, drainage and wiping were carried out 10 times and the results obtained were averaged.

The cleaning effect and relative cleaning effect $CE_{rel}$ were determined by dividing the number of wipes with the comparison cleaning preparation by the number of wipes with the cleaning preparation according to the invention to be tested. The quotient represented the relative cleaning effect $CE_{rel}$, based on the comparison cleaning preparation. The following values were obtained for the cleaning compositions:

Cleaning composition of Example 1: 2.4
Cleaning composition of Example 2: 2.6
Cleaning composition of the Comparison Example (standard): 1.0

We claim:

1. A demulsifying, powder-form aqueous preparation precursor or an aqueous liquid cleaning preparation comprising nonionic surfactants, monocarboxylic carboxylic acids, and anionic surfactants which contains in combination:

a) said nonionic surfactant being at least one alkyl ethoxylate of the formula (I):

$$R^1—O—(CH_2CH_2O)_n—H \quad (I)$$

in which $R^1$ is a linear alkyl radical containing 8 carbon atoms and n is a number of 4 to 6, b) said at least one monocaroxylic acid being of the formula (II):

$$R^2—COOH \quad (II)$$

in which $R^2$ is a branched alkyl radical containing 8 to 9 carbon atoms, or water-soluble salts thereof, c) said at least one anionic surfactant being selected from the group consisting of c1) alkyl sulfates of the formula (III):

$$R^3—O—SO_3Me \quad (III)$$

c2) alkyl polyglycol ether sulfates of the formula (IV):

$$R^4—O—(CH_2CH_2O)_m—SO_3Me \quad (IV)$$

c3) alkylaryl sulfonates of the formula (V):

$$R^5—SO_3—Me \quad (V)$$

in which $R^3$ and $R^4$ independently of one another represent linear or branched alkyl radicals containing 10 to 18 carbon atoms, m is a number of 1 to 6, $R^5$ represents alkylbenzene groups containing 7 to 9 carbon atoms and Me is an alkali metal atom, the total content of components a, b and c in the cleaning preparation being from 2.5 to 12.5% by weight, the ratio by weight of a to b being from 3:1 to 1:6 and the ratio by weight of (a+b) to c being 3:1 to 1:3, d) 5 to 97.5% by weight of at least one organic or inorganic builder selected from the group consisting of oligo- and polycarboxylic acids or water-soluble salts thereof and the alkali metal phosphates, silicates, borates, carbonates and hydroxides, e) up to 100% by weight powder-form or liquid auxiliaries and diluents.

2. A cleaning preparation of claim 1, wherein component (a) comprises an adduct of 4 mol ethylene oxide with n-octanol.

3. A cleaning preparation of claim 1, wherein component (b) comprises: 2-ethyl hexanoic acid.

4. A cleaning preparation of claim 1, wherein component (c) comprises at least one anionic composition selected from the group consisting of $C_{12-14}$ fatty alcohol sulfate sodium salt, $C_{12-14}$ fatty alcohol ether sulfate sodium salt containing 3 to 5 mol ethylene oxide and sodium salt of cumenesulfonate.

5. A cleaning preparation of claim 1 comprising at least one builder selected from the group consisting of a sodium salt of ethylenediamine tetraacetic acid and a sodium salt of nitrilotriacetic acid.

6. A cleaning preparation of claim 1 further comprising at least one member selected from the group consisting of oleic acid, sodium carbonate, urea and water.

7. A cleaning preparation of claim 2 comprising at least one builder selected from the group consisting of sodium salts of ethylene diamine tetraacetic acid and sodium salts of nitrilotriacetic acid.

8. A cleaning preparation of claim 3 comprising at least one builder selected from the group consisting of sodium salts of ethylene diamine tetraacetic acid and sodium salts of nitrilotriacetic acid.

9. A cleaning preparation of claim 4 comprising at least one builder selected from the group consisting of sodium salts of ethylene diamine tetraacetic acid and sodium salts of nitrilotriacetic acid.

10. A cleaning preparation of claim 2 further comprising at least one member selected from the group consisting of oleic acid, sodium carbonate, urea and water.

11. A cleaning preparation of claim 3 further comprising at least one member selected from the group consisting of oleic acid, sodium carbonate, urea and water.

12. A cleaning preparation of claim 4 further comprising at least one member selected from the group consisting of oleic acid, sodium carbonate, urea and water.

13. A cleaning preparation of claim 5 further comprising at least one member selected from the group consisting of oleic acid, sodium carbonate, urea and water.

14. A method for cleaning and degreasing hard surfaces which comprises contacting the hard surface to be cleaned with an aqueous solution of the composition of claim 1 wherein the concentration of (a), (b) and (c) together is from 0.01 to 3% by weight of the solution.

15. A method of claim 14 wherein the concentration of (a), (b) and (c) together is from 0.025 to 1% by weight of the solution.

* * * * *